US006597099B1

(12) United States Patent
Kyono

(10) Patent No.: US 6,597,099 B1
(45) Date of Patent: Jul. 22, 2003

(54) GLASS BULB FOR CATHODE-RAY TUBE

(75) Inventor: Masaya Kyono, Nagahama (JP)

(73) Assignee: Nippon Electric Glass Co., Ltd., Otsu (JP)

( * ) Notice: Subject to any disclaimer, the term of this patent is extended or adjusted under 35 U.S.C. 154(b) by 0 days.

(21) Appl. No.: 09/743,348

(22) PCT Filed: Apr. 24, 2000

(86) PCT No.: PCT/JP00/02669

§ 371 (c)(1),
(2), (4) Date: Jan. 9, 2001

(87) PCT Pub. No.: WO00/68969

PCT Pub. Date: Nov. 16, 2000

(30) Foreign Application Priority Data

May 10, 1999 (JP) ..... 11-128668

(51) Int. Cl.[7] ..... H01J 29/10

(52) U.S. Cl. ..... 313/477 R; 313/461; 313/408; 313/364

(58) Field of Search ..... 313/477 R, 461, 313/408, 364; 220/21 A, 21 R; 65/155; 445/45; 348/821

(56) References Cited

U.S. PATENT DOCUMENTS 5,565,731 A * 10/1996 Han ..... 313/440
6,268,692 B1 * 7/2001 Yokota et al. ..... 313/477 R
6,396,204 B1 * 5/2002 Park et al. ..... 313/440
6,404,117 B1 * 6/2002 Soneda et al. ..... 313/440
6,407,494 B1 * 6/2002 Maehara et al. ..... 313/461
6,495,954 B1 * 12/2002 Lee et al. ..... 313/477 R

FOREIGN PATENT DOCUMENTS

| | | | |
|---|---|---|---|
| EP | 0 825 632 | 2/1998 | |
| GB | 2 322 731 | 9/1998 | |
| JP | 64-82435 | * 3/1989 | ..... 313/364 |
| JP | 4-242053 | 8/1992 | |

* cited by examiner

*Primary Examiner*—Robert H. Kim
*Assistant Examiner*—Elizabeth Gemmell
(74) *Attorney, Agent, or Firm*—Armstrong, Westerman & Hattori, LLP

(57) ABSTRACT

With respect to a highly flat glass bulb for cathode ray tube having an effective screen diameter along a diagonal axis of a glass panel 10 of more than or equal to 500 mm, and an average radius of curvature of an outer surface of a face portion of more than or equal to 10,000 mm, a ratio between a length h of a skirt portion 13 of the glass panel and a distance H in the tube axis direction from an edge surface portion where a funnel is sealed with the glass panel to a reference line is defined so as to fall within a predetermined range in relation to a deflection angle θ of the funnel representing substantial degree of divergence in the tube axis direction of the funnel, thereby achieving reduction of weight of the glass bulb while maintaining a certain mechanical strength, as well as suppressing breakage during frit seal heating process.

2 Claims, 5 Drawing Sheets

D
10
11
1
12
13
14
21
22
20
23
θ
25
24
30

GLASS BULB FOR CATHODE-RAY TUBE

FIELD OF THE INVENTION

The present invention relates to a glass bulb for cathode ray tube used in a television and the like.

BACKGROUND OF THE INVENTION

As shown in FIG. 3, a glass bulb 1 for cathode ray tube generally comprises a glass panel 10 serving as a front surface portion, a funnel 20 serving as a back structural member and a neck 30 for mounting an electron gun therein. The glass panel 10 includes a face portion 11 of approximately rectangular shape having an effective screen for displaying an image, and a skirt portion 13 continued from the periphery of the face portion 11 via a blend R portion 12 and having a seal edge surface portion 14 for sealing with the funnel 20.

The funnel 20 includes a top portion 22 extending nearly vertically in the tube axis direction from a seal edge surface portion 21 for sealing with the glass panel, a yoke portion 24 outside of which a deflection yoke is to be attached, and an intermediate body portion 23 connecting the top portion and the yoke portion. A reference line 25 existing in the yoke portion is a hypothetical line used for indicating a reference position of the funnel. In the case of a color cathode ray tube, the glass panel 10 is sealed between the seal edge surface portion 14 of the skirt portion 13 and the seal edge surface portion 21 of the funnel 20 via frit glass and the like. In this context, θ designates a deflection angle in the yoke portion of the funnel 20, and is defined as an angle of divergence of an effective screen diameter D along the diagonal axis of the rectangular face portion 11 viewed from a hypothetical reference point on the reference line 25.

Since the above glass bulb 1 is used as a vacuum vessel of which interior is evacuated to vacuum, a stress caused by a pressure difference between inside and outside of the bulb will act on the outer surface of the glass bulb 1. In the case of the glass bulb which is not a spherical shell, however, as shown in FIG. 2, there arises complicated distribution of stress such that an area of tensile stress denoted by arrows toward outside of the bulb and an area of compressive stress denoted by arrows toward inside of the bulb are present at the same time.

The vacuum tensile stress generated in the glass bulb 1 usually becomes maximum in end regions on the short axis of the glass panel 10, and when a mechanical or thermal shock exceeding a certain degree is applied to the glass bulb 1 from the outside, the glass bulb 1 breaks from the vicinity of the region where the maximum vacuum tensile stress is generated, that is from the region ranging from the end of the face portion 11 to the skirt portion 13 as its origin of breakage, resulting in implosion. Therefore, the glass bulb 1 used in a cathode ray tube is usually designed to have an enough mechanical strength to suppress the vacuum tensile stress to a predetermined value or less.

The distribution of vacuum tensile stress depends on the size and shape of the glass bulb, and thus the shape, wall thickness and the like are usually designed so as to suppress the vacuum tensile stress generated at the seal edge portion between the glass panel and the funnel to less than about 8.4 MPa, which is one standard of mechanical strength required for a glass bulb determined in consideration of safety factors such as shocks applied from the outside.

For this reason, in conventional glass bulbs for cathode ray tube, in order to suppress the vacuum tensile stress to less than the predetermined value while maintaining the mechanical strength, such measures have been taken as increasing the wall thickness of the panel, elongating the skirt portion for relieving and distributing the vacuum tensile stress generated in the vicinity of the skirt portion to thereby reduce the peak value thereof, and the like.

In conventional glass bulbs for cathode ray tube, however, since the weight of the glass is increased because of the increased wall thickness of the panel or the elongated skirt potion, there is a problem that the glass bulb is inferior in operability and workability.

Moreover, the glass panel is formed by press molding of a molten glass gob and then gradually cooled to manufacture the glass panel of room temperature. However, during the continuous cooling process, delay condition occurs in cooling degree of each portion because of the three-dimensional box-shaped structure and uneven distribution of the wall thickness, so that the glass panel is usually cooled with the temperature distribution being uneven, causing the portion whose temperature has dropped below the temperature of the strain point to sequentially solidify. The strain point is the point that viscous flow of the glass is substantially stopped.

As a result, when the glass panel is brought to the room temperature, the distortion appears as warpage of the glass panel which will generally cause inward inclination in the vicinity of the seal edge surface portion on the short axis and long axis of the glass panel and outward inclination in the vicinity of the seal edge portion on the diagonal axis, and tensile stresses remain outside of the seal edge surface portion on the diagonal axis.

Furthermore, also in the frit seal heating process at the time of sealing the glass panel with the funnel, uneven temperature distribution occurs within the glass panel and a temporary distortion which will cause the seal edge surface portion on the diagonal axis to incline outwardly occurs, resulting that a tensile stress is exerted and the glass tends to break due to the resultant with the remaining tensile stress at the time of the molding as described above. This tendency is significantly problematic in a glass panel in which the skirt portion is elongated in a large panel having a flat face portion.

The applicant of the invention has applied an invention relating a glass panel for cathode ray tube in which weight reduction is enabled by shortening the skirt portion while maintaining the mechanical strength as a glass bulb for international patent (PCT/JP99/07135).

FIG. 6 shows a section in the short axis direction of the glass panel for cathode ray tube which comprises the face portion 11 of substantially rectangular shape, and the skirt portion 13 connected with the periphery of the face portion via the blend R portion 12 and having the seal edge surface 14 for sealing with the funnel. In the above international patent application, the glass panel for cathode ray tube having the shape as shown in FIG. 6 is so configured that an effective screen diameter D(mm) of the glass panel along the diagonal axis thereof is in the range of $500 \leqq D < 650$; an average radius of curvature of the outer surface of the face portion 11 is more than or equal to 10,000 mm in any radial direction passing the center of the face portion; and a distance h (mm) along the tube axis from a contact between the effective screen end of the inner surface of the glass panel and the blend R portion 12 to the seal edge surface 14 at least along the short axis of the glass panel, and a glass wall thickness t(mm) of the seal edge surface 14 satisfy the relationships of: $0.07D \leqq h \leqq 0.11D$, $0.015D \leqq t \leqq 0.025D$ and $(D/25.4)^2 \leqq t \times h \leqq (D/25.4+3)^2$, or that the effective screen diameter D(mm) of the glass panel along the diagonal axis thereof is more than or equal to 650; the average radius of curvature of the outer surface of the face portion is more than or equal to 10,000 mm in any radial direction passing the center of the face portion; and the distance h (mm) along the tube axis from the contact between the effective screen end of the inner surface of the glass panel and the blend R portion 12 to the seal edge surface 14 at least along the short axis of the glass panel, and the glass wall thickness t (mm) of the seal edge surface 14 satisfy the relationships of: $0.08D \leqq h \leqq 0.11D$, $0.015D \leqq t \leqq 0.020D$ and $(D/25.4)^2 \leqq t \times h \leqq (D/25.4+2.5)^2$. In such a way, the above international patent application suggests the technique for reducing the weight of the glass panel compared to the prior art by shortening the skirt portion 13, while maintaining the mechanical strength as a glass bulb.

It is an object of the invention to provide a glass bulb for cathode ray tube in which, by combining the condition of the glass panel for cathode ray tube suggested by the above invention of international patent application into a glass bulb for cathode ray tube having a glass panel which is large in size and having a flat face portion, proper relationship between the glass panel and the funnel in length along the tube axis direction is defined, reduction in weight is achieved by shortening the panel skirt portion while maintaining a certain mechanical strength as a glass bulb, a tensile stress which will occur outside the seal edge surface portion on the diagonal axis is reduced, and breakage during frit seal heating process and the like is suppressed.

SUMMARY OF THE INVENTION

The present invention is featured in that, with respect to a highly flat glass bulb for cathode ray tube having an effective screen diameter in the direction of a diagonal axis of a glass panel of more than or equal to 500 mm, and an average radius of curvature of an outer surface of a face portion of more than or equal to 10,000 mm, from the view point of achieving reduction of weight of the glass bulb while maintaining a certain mechanical strength, as well as suppressing breakage during frit seal heating process, a ratio between a length h of a skirt portion of the glass panel and a distance H in a tube axis direction from an edge surface portion where a funnel is sealed with the glass panel to a reference line is defined so as to fall within a predetermined range in relation to a deflection angle θ of the funnel representing substantial degree of diversion in the tube axis direction of the funnel.

In specific, the present invention provides a glass bulb for cathode ray tube comprising: a glass panel having a skirt portion continued from a face portion of approximately rectangular shape forming an effective screen via a blend R portion; a funnel having a reference line in a yoke portion, the funnel being sealed with the glass panel; and a neck sealed with the funnel, to which an electron gun is attached, wherein an effective screen diameter D (mm) along a diagonal axis of the face portion of the glass panel is in the range of $500 \leqq D < 650$; an average radius of curvature of an outer surface of the face portion is more than or equal to 10,000 mm in any radial direction passing the center of the face portion; and a length h (mm) of the skirt portion in a tube axis direction from a contact between an end of the effective screen of an inner surface of the face portion and the blend R portion to an edge surface portion where the glass panel is sealed with the funnel at least along a short axis of the glass panel, a deflection angle θ (°) of the yoke portion of the funnel, and a distance H (mm) in the tube axis direction from an edge surface portion where the funnel is sealed with the glass panel to the reference line satisfy the relationship of: $1/(0.22 \tan(\theta/2))-1 \leqq H/h \leqq 1/(0.14 \tan(\theta/2))-1$.

Alternatively, the present invention is characterized in that an effective screen diameter D (mm) along a diagonal axis of the face portion of the glass panel is more than or equal to 650; an average radius of curvature of an outer surface of the face portion is more than or equal to 10,000 mm in any radial direction passing the center of the face portion; and a length h (mm) of the skirt portion in a tube axis direction from a contact between an end of the effective screen of an inner surface of the face portion and the blend R portion to an edge surface portion where the glass panel is sealed with the funnel at least along a short axis of the glass panel, a deflection angle θ (°) of the yoke portion of the funnel, and a distance H (mm) in the tube axis direction from an edge surface portion where the funnel is sealed with the glass panel to the reference line satisfy the relationship of: $1/(0.22 \tan(\theta/2))-1 \leqq H/h \leqq 1/(0.16 \tan(\theta/2))-1$.

The reason why the specification of the length h of the skirt portion of the glass panel was made on the short axis of the glass panel is that the maximum vacuum tensile stress on the glass bulb is usually generated in the region ranging from the end of the face portion to the skirt portion on the short axis, however, in the case of a panel having a flat face portion as described above, the length h of the skirt portion specified on the short axis is substantially equal to those specified on the long axis and the diagonal axis, and also substantially equal to the distance in the tube axis direction from the inner surface of the center of the panel to the panel seal edge surface portion.

Therefore, the effective surface diameter D of the glass panel along the diagonal axis is represented by $D=2(H+h)\tan(\theta/2)$ by using the H and θ of the funnel and the length h of the skirt portion as defined above. To the contrary, in the suggestion in the invention of the above-mentioned international patent application, the range of the ratio between the length h of the skirt portion of the glass panel and the effective screen diameter D of the glass panel along the diagonal axis is defined by the inequalities of $0.07 \leqq h/D \leqq 0.11$ when the effective screen diameter D (mm) is in the range of $500 \leqq D < 650$, and $0.08D \leqq h/D \leqq 0.11$ when the effective screen diameter D (mm) is more than or equal to 650 from the view point of weight reduction and the strength.

In view of the above, a relation between the length h of the skirt portion of the glass panel and the distance H in the tube axis direction from the edge surface portion where the funnel is sealed with the glass panel to the reference line is determined from the above inequalities and the above expressions of the effective screen diameter D, then the inequalities of H/h according to the present invention are derived. In addition, we confirmed that when the relationship in length between the panel and the funnel in the tube axis direction falls in the range defined by the above inequalities, it is desirable also from the view point of suppressing breakage from the outside of the seal edge surface portion on the diagonal axis of the glass panel.

In general, the wall thickness of the funnel is not more than about a half of that of the panel, and the wall thickness gradually decreases from the seal edge surface portion to the yoke portion. Also the distance from the tube axis is smaller in the body portion compared with the seal edge surface portion. Therefore, in the bulbs having the same deflection angle, by shortening the length of the skirt portion of the panel in the tube axis direction and extending the length of the body portion of the funnel by the corresponding amount, it is possible to reduce the volume of the glass without changing the entire length of the bulb in the tube axis direction, so that weight reduction can be achieved.

Furthermore, another reason why the above dimension H of the funnel is corrected by extending the body portion of the funnel is that the shapes and dimensions of the yoke portion of the funnel and the seal edge surface portion are relatively fixedly defined in relation to outside attachment of the deflection yoke and fitting with the panel, respectively, while on the other hand, the shape and dimension of the body portion can be relatively freely designed because the body portion is the part constituting the vessel as a bulb.

In the case where the ratio H/h is $1/(0.22\tan(\theta/2))-1>H/h$, since the length of the skirt portion is not reduced, it is impossible to reduce the weight of the glass bulb and the tensile stress in the seal edge surface portion along the diagonal axis of the glass panel becomes relatively large, so that it is impossible to sufficiently suppress breakage caused by thermal shock at the time of subjecting the glass panel and the funnel to a frit seal heating process and the like.

On the other hand, in the case where $500\leqq D<650$ and $H/h>1/(0.14\tan(\theta/2))-1$ or where $650\leqq D$ and $H/h>1/(0.16\tan(\theta/2))-1$, the length of the skirt portion is reduced too much, causing the vacuum tensile stress value of the seal edge portion generated by evacuation of the glass bulb to become more than 8.4 MPa, so that it is impossible to obtain a desired mechanical strength required for a glass bulb.

According to the glass bulb for cathode ray tube of the present invention, since the ratio between the length of the skirt portion of the panel and the length in the tube axis direction of the funnel is set in a proper range, that is, the length of the skirt portion of the panel which has conventionally been longer than needed is shortened to a suitable dimension while the body portion in particular of the funnel is extended by the corresponding amount to compensate the shortening, thereby accomplishing reduction of weight without changing the entire length of the cathode ray tube, as well as maintaining the pressure resistance of the cathode ray tube at a necessary level, it is possible to provide a glass bulb for cathode ray tube which is easy to handle and suppresses the occurrence of breakage in the neighborhood of the sealing portion along the diagonal axis caused by thermal shock due to frit seal heating process and the like.

DETAILED DESCRIPTION OF THE PREFERRED EMBODIMENTS

Figure 1:
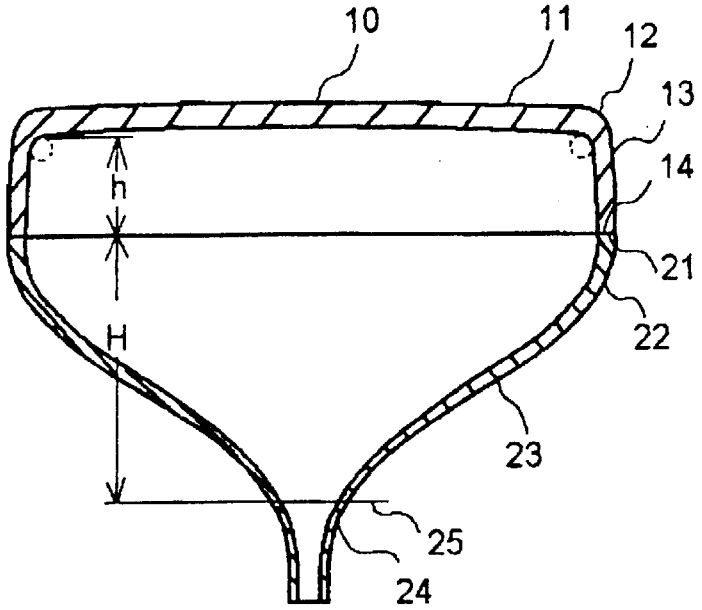
FIG. 1 is an explanatory view in short axial section of a glass bulb for cathode ray tube according to the present invention.
Figure 2:
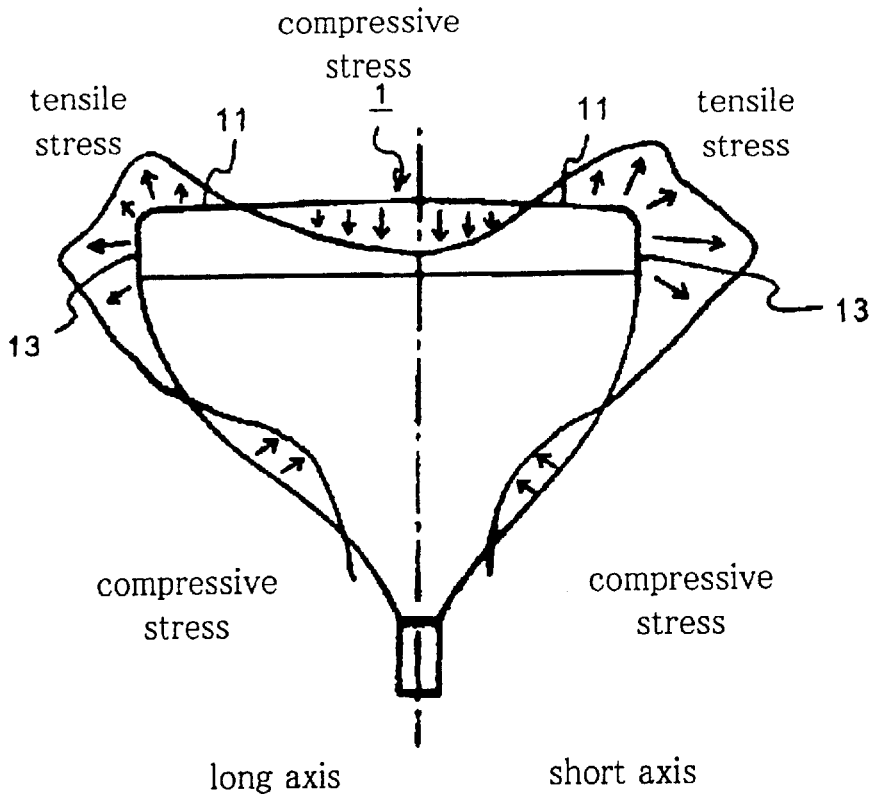
FIG. 2 is an explanatory view of distribution of vacuum stress generated in the glass bulb for cathode ray tube.
Figure 3:
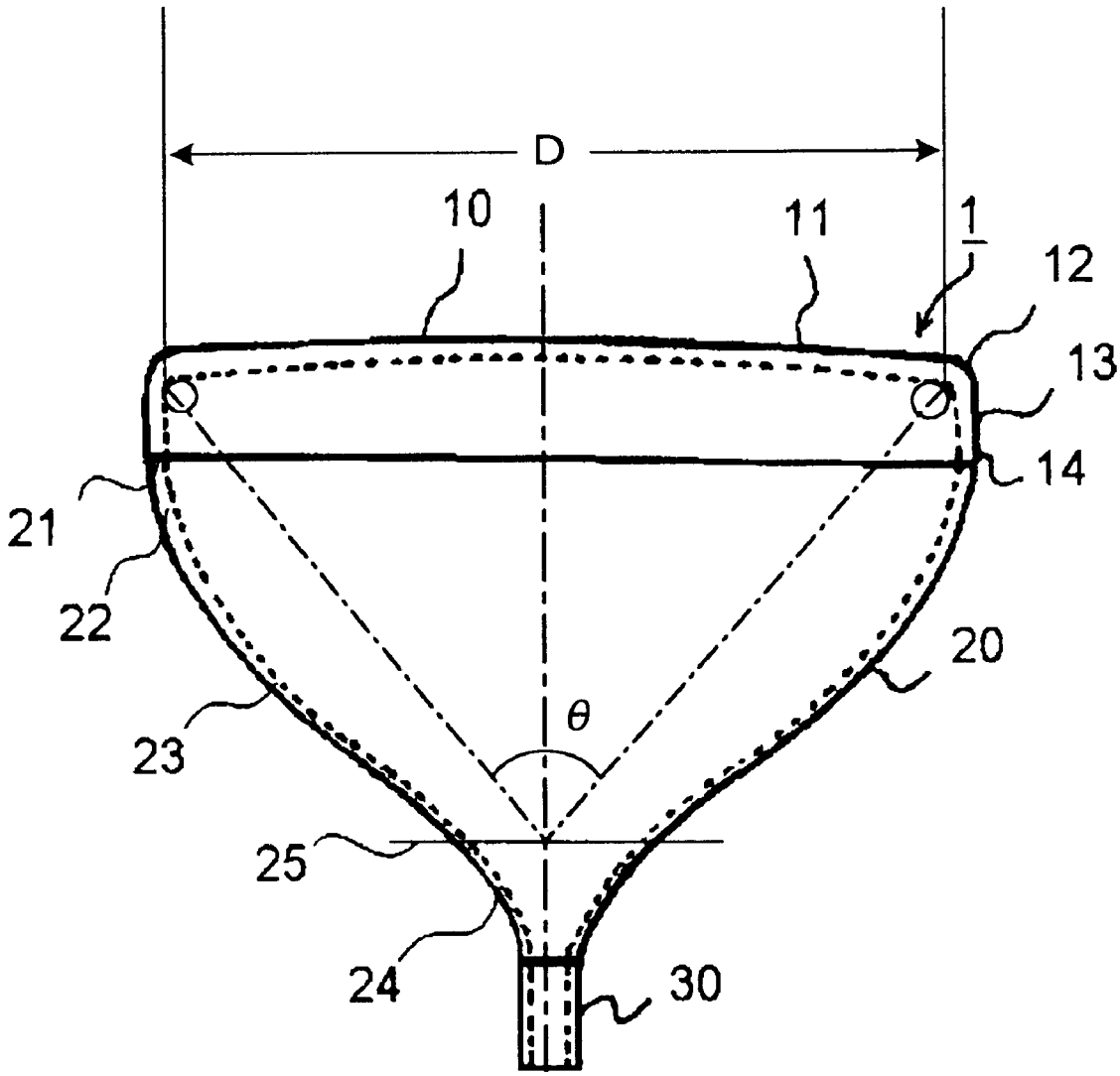
FIG. 3 is an explanatory view of a glass bulb for cathode ray tube.

In the following, a glass bulb for cathode ray tube according to the present invention will be described with reference to working examples. FIG. 1 is an explanatory view in short axial section of a glass bulb for cathode ray tube according to the present invention. The components as same as those described above will be denoted by the same reference numerals and explanations thereof will be omitted.

In the drawing, the reference numeral "h" denotes a distance in the tube axis direction along the short axis of the glass panel 10 from a contact between the end portion of the effective screen of the inner surface of the face portion 11 and the blend R portion 12 to the seal edge surface portion 14, of the skirt portion 13 which is defined as the length of the skirt portion. The reference numeral "H" denotes a distance along the tube axis direction from the seal edge surface portion 21 of the funnel 20 to the reference line 25.

Panels and funnels used for glass bulbs for cathode ray tube according to the present invention, and panels and funnels used for glass bulbs of comparative examples were individually manufactured and the weights of these panels and funnels were measured. After sealing the funnel and a neck to the corresponding glass panel to make a glass bulb, the air was exhausted from the interior thereof, and then a vacuum tensile stress value of the seal edge portion of each glass bulb was measured by means of a strain gauge.

A mechanical strength of the glass bulb was evaluated by measuring the vacuum tensile stress value generated at the seal edge portion. Additionally, before crystallizing the glass panel at about 440° C. for 40 minutes which is a typical condition for heat treatment at the time of frit sealing a glass panel and a funnel, the situation with regard to breakage when the glass panel was heated from the room temperature to about 440° C. at a temperature gradient of 12 to 13° C./min. was monitored as an acceleration test.

Tables of FIGS. 1 to 4 each show dimensions of portions of the glass panels for cathode ray tube and the funnels, weights of the glass bulbs, values of vacuum tensile stress generated in the seal edge portion in the form of a glass bulb and ratios of breakage at the time of conducting the frit seal heating process. In each table, Samples 2, 3, 4, 5, 7 and 8 are examples using the bulbs for cathode ray tube according to the present invention, Sample 1 is a conventional example and Sample 6 is a comparative example. Sample 7 is an example where the deflection angle is set at 110° and Sample 8 is an example where the deflection angle is set at 103° or 90°.

Table 1 shows data for bulbs consisting of a panel having an effective screen diameter along the diagonal axis of the glass panel of 510 mm (21 inches), an aspect ratio of 4:3 and a minimum average radius of curvature of the outer surface of the face portion of 33,000 mm and funnels having deflection angels of 88°, 110° and 103°.

In the bulbs for cathode ray tube of Samples 2 to 5 according to the present invention, it was possible to reduce the weight by about 0.6 kg at the maximum compared to the conventional bulb for cathode ray tube as shown by Sample 1, and a desirable result was obtained that the vacuum tensile stress at the seal edge portion was less than the standard value of 8.4 MPa for all Samples. Furthermore, the bulbs for cathode ray tube of Samples 2 to 5 according to the present invention were able to suppress the rate of breakage caused by thermal shock at the time of frit seal heating process better than the conventional bulb for cathode ray tube as shown by Sample 1. With regard to Samples 4 and 5, since the wall thickness of the seal edge portion was adjusted so as to suppress the increase in vacuum tensile stress of the seal edge portion caused by the shortening of the skirt portion, Samples 4 and 5 became heavier than Sample 3, but weight reduction compared to Sample 1 was realized.

With regard to Sample 6 which is a comparative example, though an attempt was made to adjust the wall thickness of the seal edge portion in order to suppress the increase in vacuum tensile stress of the seal edge portion caused by the shortening of the skirt portion, it was impossible to achieve the vacuum tensile stress of not more than 8.4 MPa at the weight lighter than that of Sample 1 which is a conventional example. With regard to Samples 7 and 8, the examples of the present invention where the deflection angle of the funnel is set at 110° and 103°, respectively, they presented desirable results as is the case of 88° according to the present invention.

Table 2 shows data for bulbs consisting of a panel having an effective screen diameter along the diagonal axis of the glass panel of 600 mm (25 inches), an aspect ratio of 4:3 and a minimum average radius of curvature of the outer surface of the face portion of 30,000 mm and funnels having deflection angels of 106°, 110° and 90°.

In the bulbs for cathode ray tube of Samples 2 to 5 according to the present invention, it was possible to reduce the weight by about 0.5 kg at the maximum compared to the conventional bulb for cathode ray tube as shown by Sample 1, and a desirable result was obtained that the vacuum tensile stress at the seal edge portion was less than the standard value of 8.4 MPa for all Samples. Furthermore, the bulbs for cathode ray tube of Samples 2 to 5 according to the present invention were able to suppress the rate of breakage caused by thermal shock at the time of frit seal heating process better than the conventional bulb for cathode ray tube as shown by Sample 1.

With regard to Samples 4 and 5, since the wall thickness of the seal edge portion was adjusted so as to suppress the increase in vacuum tensile stress of the seal edge portion caused by the shortening of the skirt portion, Samples 4 and 5 became heavier than Sample 3, but weight reduction compared to Sample 1 was realized. With regard to Sample 6 which is a comparative example, though an attempt was made to adjust the wall thickness of the seal edge portion in order to suppress the increase in vacuum tensile stress of the seal edge portion caused by the shortening of the skirt portion, it was impossible to achieve the vacuum tensile stress of not more than 8.4 MPa at the weight lighter than that of Sample 1 which is a conventional example. With regard to Samples 7 and 8, the examples of the present invention where the deflection angle of the funnel is set at 110° and 90°, respectively, they presented desirable results as is the case of 106° according to the present invention.

Table 3 shows data for bulbs consisting of a panel having an effective screen diameter along the diagonal axis of the glass panel of 760 mm (32 inches), an aspect ratio of 16:9 and a minimum average radius of curvature of the outer surface of the face portion of 100,000 mm and funnels having deflection angels of 103°, 110° and 90°.

In the bulbs for cathode ray tube of Samples 2–5 according to the present invention, it was possible to reduce the weight by about 0.5 kg at the maximum compared to the conventional bulb for cathode ray tube as shown by Sample 1, and a desirable result was obtained that the vacuum tensile stress at the seal edge portion was less than the standard value of 8.4 MPa for all Samples. Furthermore, the bulbs for cathode ray tube of Samples 2 to 5 according to the present invention were able to suppress the rate of breakage caused by thermal shock at the time of frit seal heating process better than the conventional bulb for cathode ray tube as shown by Sample 1.

With regard to Samples 4 and 5, since the wall thickness of the seal edge portion was adjusted so as to suppress the increase in vacuum tensile stress of the seal edge portion caused by the shortening of the skirt portion, Samples 4 and 5 became heavier than Sample 3, but weight reduction compared to Sample 1 was realized. With regard to Sample 6 which is a comparative example, though an attempt was made to adjust the wall thickness of the seal edge portion in order to suppress the increase in vacuum tensile stress of the seal edge portion caused by the shortening of the skirt portion, it was impossible to achieve the vacuum tensile stress of not more than 8.4 MPa at the weight lighter than that of Sample 1 which is a conventional example. With regard to Samples 7 and 8, the examples of the present invention where the deflection angle of the funnel is set at 110° and 90°, respectively, they presented desirable results as is the case of 103° according to the present invention.

Table 4 shows data for bulbs consisting of a panel having an effective screen diameter along the diagonal axis of the glass panel of 860 mm (36 inches), an aspect ratio of 16:9 and a minimum average radius of curvature of the outer surface of the face portion of 50,000 mm and funnels having deflection angels of 103°, 110° and 90°.

In the bulbs for cathode ray tube of Samples 2–5 according to the present invention, it was possible to reduce the weight by about 1.0 kg at the maximum compared to the conventional bulb for cathode ray tube as shown by Sample 1, and a desirable result was obtained that the vacuum tensile stress at the seal edge portion was less than the standard value of 8.4 MPa for all Samples. Furthermore, the bulbs for cathode ray tube of Samples 2 to 5 according to the present invention were able to suppress the rate of breakage caused by thermal shock at the time of frit seal heating process better than the conventional bulb for cathode ray tube as shown by Sample 1.

With regard to Sample 5, since the wall thickness of the seal edge portion was adjusted so as to suppress the increase in vacuum tensile stress of the seal edge portion caused by the shortening of the skirt portion, Sample 5 became heavier than Sample 4, but weight reduction compared to Sample 1 was realized. With regard to Sample 6 which is a comparative example, though an attempt was made to adjust the wall thickness of the seal edge portion in order to suppress the increase in vacuum tensile stress of the seal edge portion caused by the shortening of the skirt portion, it was impossible to achieve the vacuum tensile stress of not more than 8.4 MPa at the weight lighter than that of Sample 1 which is a conventional example. With regard to Samples 7 and 8, the examples of the present invention where the deflection angle of the funnel is set at 110° and 90°, respectively, they presented desirable results as is the case of 103° according to the present invention.

In the working examples shown in Tables 1 to 4, though the glass wall thickness t of the seal edge surface of the skirt portion is made smaller than the center wall thickness of the face portion 11, and it can be understood that a mechanical strength of more than or equal to the predetermined value can be secured even if the glass wall thickness t of the seal edge surface of the skirt portion is smaller than the center wall thickness of the face portion of the panel for cathode ray tube as far as the ratio in the length of the funnel and the skirt of the glass bulb for cathode ray tube is within the range defined by the present invention.

Figure 4:
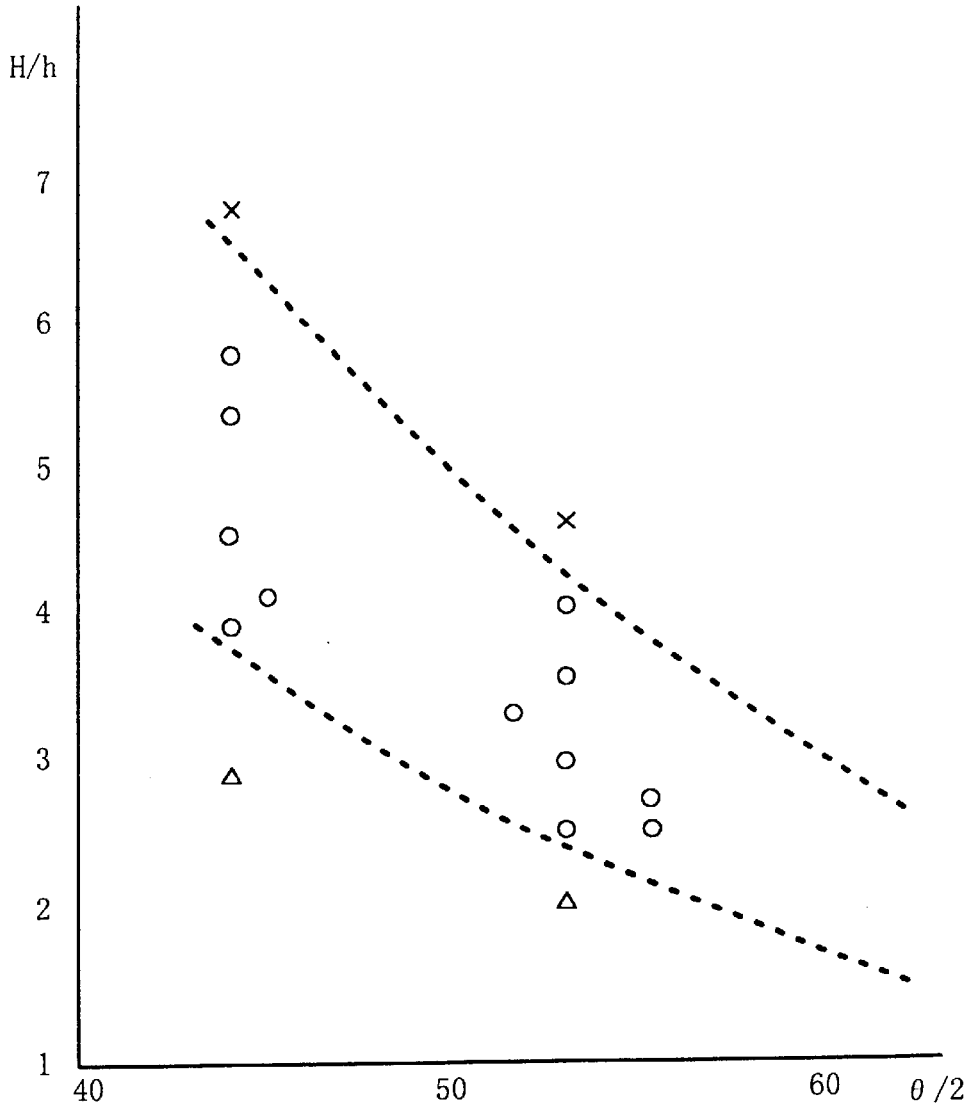
FIGS. 4 and 5 are graphs showing ranges of H/h set for glass bulbs for cathode ray tube having different sizes according to the present invention.

FIG. 4 is a graph showing the data of Tables 1 and 2 wherein the horizontal axis represents "θ/2" and the vertical axis represents "H/h". The symbol Δ represents Sample 1 which is the conventional example, the symbol ○ represents glass panels of Samples 2 to 5, 7, 8 according to the present invention wherein the desired mechanical strength required for a glass bulb and weight reduction were accomplished, and the symbol X represents Sample 6 which is the comparative example wherein the desired mechanical strength required for a glass bulb and weight reduction were not accomplished. The dotted lines shown in FIG. 4 denote graphs of: $H/h=1/(0.22\tan(\theta/2))-1$, $H/h=1/(0.14\tan(\theta/2))-1$, respectively.

Figure 5:
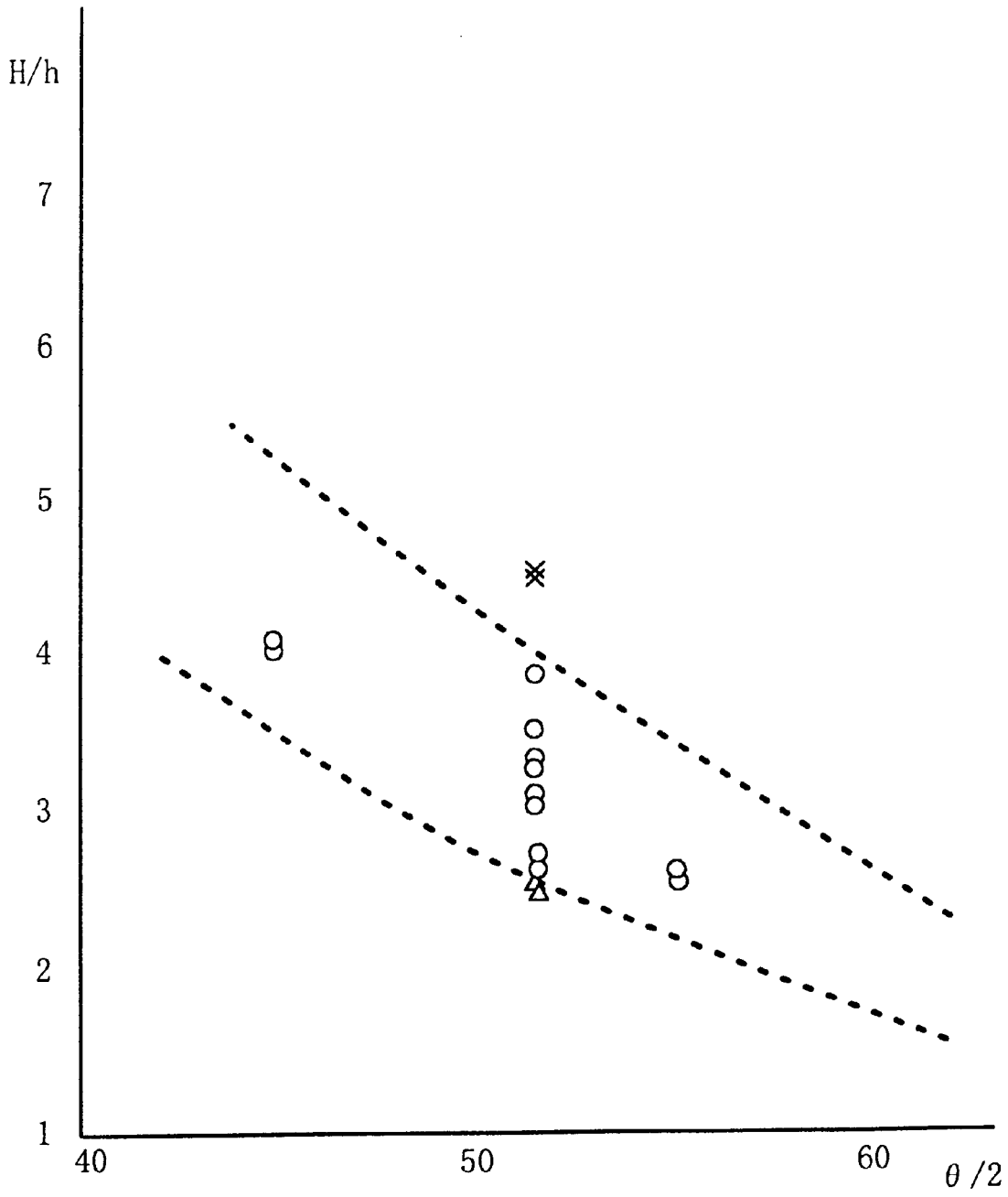
Figure 6:
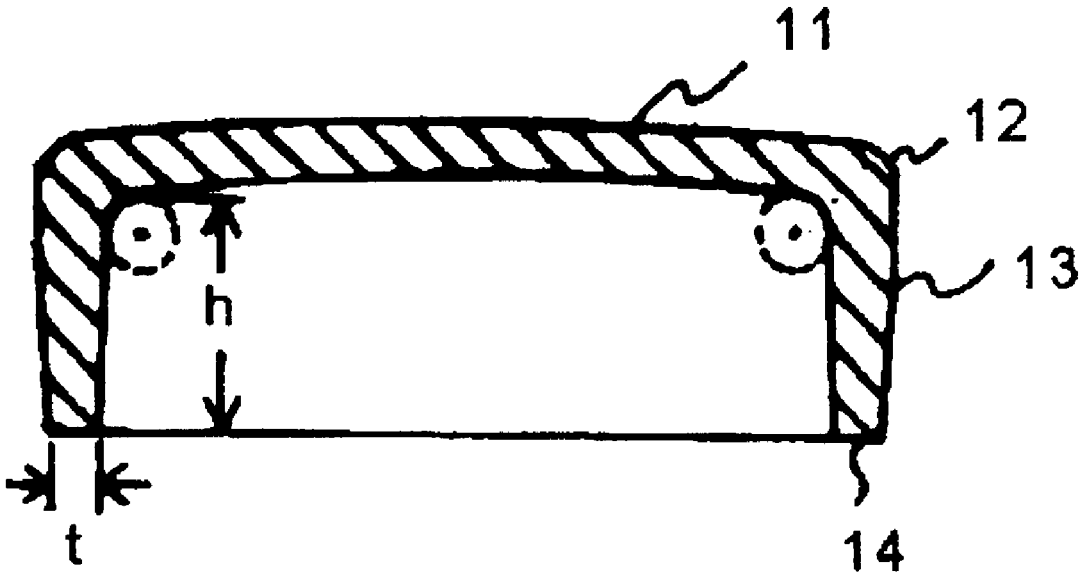
FIG. 6 is an explanatory view in short axial section of a glass panel for cathode ray tube used in the present invention.

FIG. 5 is a graph showing the data of Tables 3 and 4 wherein the horizontal axis represents "θ/2" and the vertical axis represents "H/h". The symbol Δ represents Sample 1 which is the conventional example, the symbol ○ represents glass panels of Samples 2 to 5, 7, 8 according to the present invention wherein the desired.mechanical strength required for a glass bulb and weight reduction were accomplished, and the symbol X represents Sample 6 which is the comparative example wherein the desired mechanical strength required for a glass bulb and weight reduction were not accomplished. The dotted lines shown in FIG. 5 denote graphs of: $H/h=1/(0.22\tan(\theta/2))-1$, $H/h=1/(0.16\tan(\theta/2))-1$, respectively.

In view of FIGS. 4 and 5, the desired mechanical strength required for a glass bulb and weight reduction can be accomplished, and also suppressive effects on breakage during frit seal heating process can be accomplished in the range of $1/(0.22\tan(\theta/2))-1 \leqq H/h \leqq 1/(0.14\tan(\theta/2))-1$ in the case where the effective screen diameter D (mm) along the diagonal axis of the glass panel is 510 and 600, that is D is generally in the range of $500 \leqq D < 650$, or alternatively in the range of $1/(0.22\tan(\theta/2))-1 \leqq H/h \leqq 1/(0.16\tan(\theta/2))-1$ in the case where the effective screen diameter D (mm) along the diagonal axis of the glass panel is 760 and 860, that is D is generally in more than or equal to 650.

UTILITY IN THE INDUSTRIAL FIELD

According to the glass bulb for cathode ray tube of the present invention, excellent effects are accomplished that weight reduction is achieved by shortening the skirt portion of the panel while maintaining a certain mechanical strength as a glass bulb, and that breakage from the neighborhood of the seal edge portion along the diagonal axis caused by thermal shock during frit seal heating process and the like can be suppressed.

TABLE 1

| Sample No. | Skirt length h (mm) | Funnel length H (mm) | Wall thickness of seal edge surface t (mm) | Maximum vacuum tensile stress (MPa) | Bulb weight (kg) | Deflection angle θ (°) | Rate Of breakage during frit sealing | H/h |
|---|---|---|---|---|---|---|---|---|
| 1 | 69 | 201 | 9.0 | 4.3 | 15.7 | 88 | 2/10 | 2.91 |
| 2 | 55 | 215 | 9.0 | 5.9 | 15.4 | 88 | 0/10 | 3.91 |
| 3 | 49 | 221 | 9.0 | 7.2 | 15.1 | 88 | 0/10 | 4.51 |
| 4 | 43 | 227 | 10.0 | 8.3 | 15.3 | 88 | 0/10 | 5.28 |
| 5 | 40 | 230 | 11.0 | 8.3 | 15.6 | 88 | 0/10 | 5.75 |
| 6 | 35 | 235 | 12.5 | 8.5 | 16.3 | 88 | 0/10 | 6.71 |
| 7 | 49 | 135 | 9.0 | 8.2 | 14.3 | 110 | 0/10 | 2.76 |
| 8 | 49 | 159 | 9.0 | 8.0 | 14.5 | 103 | 0/10 | 3.24 |

Effective screen diameter on diagonal axis: D = 510 mm
Minimum value of outer surface average radius of curvature: 33,000 mm
Center wall thickness of face portion: 15 mm
$1/(0.22\tan(\theta/2))-1$ : 3.71(θ = 88), 2.18(θ = 110), 2.62(θ = 103)
$1/(0.14\tan(\theta/2))-1$ : 6.40(θ = 88), 4.00(θ = 110), 4.68(θ = 103)

TABLE 2

| Sample No. | Skirt length h (mm) | Funnel length H (mm) | Wall thickness of seal edge surface t (mm) | Maximum vacuum tensile stress (MPa) | Bulb weight (kg) | Deflection angle θ (°) | Rate Of breakage during frit sealing | H/h |
|---|---|---|---|---|---|---|---|---|
| 1 | 76 | 157 | 9.5 | 7.0 | 20.7 | 106 | 3/10 | 2.07 |
| 2 | 67 | 166 | 9.5 | 7.5 | 20.4 | 106 | 0/10 | 2.48 |
| 3 | 59 | 174 | 9.5 | 7.9 | 20.2 | 106 | 0/10 | 2.95 |
| 4 | 51 | 182 | 13.0 | 8.3 | 20.4 | 106 | 0/10 | 3.57 |
| 5 | 45 | 188 | 13.0 | 8.3 | 20.6 | 106 | 0/10 | 4.18 |
| 6 | 41 | 192 | 14.5 | 8.6 | 21.2 | 106 | 0/10 | 4.68 |
| 7 | 59 | 151 | 9.5 | 8.0 | 19.5 | 110 | 0/10 | 2.56 |
| 8 | 59 | 241 | 9.5 | 7.7 | 21.0 | 90 | 0/10 | 4.08 |

Effective screen diameter on diagonal axis: D = 600 mm
Minimum value of outer surface average radius of curvature: 30,000 mm
Center wall thickness of face portion: 14.8 mm
$1/(0.22\tan(\theta/2))-1$ : 2.43(θ = 106), 2.18(θ = 110), 3.55(θ = 90)
$1/(0.14\tan(\theta/2))-1$ : 4.38(θ = 106), 4.00(θ = 110), 6.14(θ = 90)

TABLE 3

| Sample No. | Skirt length h (mm) | Funnel length H (mm) | Wall thickness of seal edge surface t (mm) | Maximum vacuum tensile stress (MPa) | Bulb weight (kg) | Deflection angle θ (°) | Rate Of breakage during frit sealing | H/h |
|---|---|---|---|---|---|---|---|---|
| 1 | 86 | 216 | 11.5 | 7.2 | 37.5 | 103 | 2/10 | 2.51 |
| 2 | 82 | 220 | 11.5 | 7.5 | 37.3 | 103 | 0/10 | 2.68 |
| 3 | 75 | 227 | 12.0 | 7.7 | 37.0 | 103 | 0/10 | 3.03 |
| 4 | 70 | 232 | 13.0 | 7.9 | 37.2 | 103 | 0/10 | 3.31 |
| 5 | 62 | 240 | 14.5 | 8.3 | 37.4 | 103 | 0/10 | 3.87 |
| 6 | 57 | 245 | 15.0 | 8.6 | 37.9 | 103 | 0/10 | 4.30 |
| 7 | 74 | 192 | 11.5 | 8.0 | 36.1 | 110 | 0/10 | 2.59 |
| 8 | 74 | 306 | 11.5 | 7.6 | 38.1 | 90 | 0/10 | 4.14 |

Effective screen diameter on diagonal axis: D = 760 mm
Minimum value of outer surface average radius of curvature: 100,000 mm
Center wall thickness of face portion: 19 mm
1/(0.22 tan(θ/2))-1 : 2.62(θ = 103), 2.18(θ = 110), 3.55(θ = 90)
1/(0.14 tan(θ/2))-1 : 3.97(θ = 103), 3.38(θ = 110), 5.25(θ = 90)

TABLE 4

| Sample No. | Skirt length h (mm) | Funnel length H (mm) | Wall thickness of seal edge surface t (mm) | Maximum vacuum tensile stress (MPa) | Bulb weight (kg) | Deflection angle θ (°) | Rate Of breakage during frit sealing | H/h |
|---|---|---|---|---|---|---|---|---|
| 1 | 97 | 252 | 13.5 | 7.4 | 53.8 | 103 | 2/10 | 2.60 |
| 2 | 93 | 256 | 13.5 | 7.7 | 53.6 | 103 | 0/10 | 2.75 |
| 3 | 85 | 264 | 13.5 | 8.0 | 53.1 | 103 | 0/10 | 3.11 |
| 4 | 80 | 269 | 14.5 | 8.2 | 52.8 | 103 | 0/10 | 3.36 |
| 5 | 77 | 272 | 15.5 | 8.3 | 53.7 | 103 | 0/10 | 3.53 |
| 6 | 65 | 284 | 17.0 | 8.6 | 54.2 | 103 | 0/10 | 4.37 |
| 7 | 85 | 216 | 13.5 | 8.1 | 52.0 | 110 | 0/10 | 2.54 |
| 8 | 85 | 345 | 13.5 | 7.8 | 54.5 | 90 | 0/10 | 4.06 |

Effective screen diameter on diagonal axis: D = 860 mm
Minimum value of outer surface average radius of curvature: 50,000 mm
Center wall thickness of face portion: 20 mm
1/(0.22 tan(θ/2))-1 : 2.62(θ = 103), 2.18(θ = 110), 3.55(θ = 90)
1/(0.16 tan(θ/2))-1 : 3.97(θ = 103), 3.38(θ = 110), 5.25(θ = 90)

What is claimed is:

1. A glass bulb for cathode ray tube comprising: a glass panel having a skirt portion continued from a face portion of approximately rectangular shape forming an effective screen via a blend R portion; a funnel having a reference line in a yoke portion, the funnel being sealed with the glass panel; and a neck sealed with the funnel, to which an electron gun is attached, wherein an effective screen diameter D (mm) along a diagonal axis of the face portion of the glass panel is in the range of $500 \leqq D < 650$; an average radius of curvature of an outer surface of the face portion is more than or equal to 10,000 mm in any radial direction passing the center of the face portion; and a length h (mm) of the skirt portion in a tube axis direction from a contact between an end of the effective screen of an inner surface of the face portion and the blend R portion to an edge surface portion where the glass panel is sealed with the funnel at least along a short axis of the glass panel, a deflection angle θ (°) of the yoke portion of the funnel, and a distance H (mm) in the tube axis direction from an edge surface portion where the funnel is sealed with the glass panel to the reference line satisfy the relationship of: $1/(0.22\ \tan(\theta/2))-1 \leqq H/h \leqq 1/(0.14\ \tan(\theta/2))-1$.

2. A glass bulb for cathode ray tube comprising: a glass panel having a skirt portion continued from a face portion of approximately rectangular shape forming an effective screen via a blend R portion; a funnel having a reference line in a yoke portion, the funnel being sealed with the glass panel; and a neck sealed with the funnel, to which an electron gun is attached, wherein an effective screen diameter D (mm) along a diagonal axis of the face portion of the glass panel is more than or equal to 650; an average radius of curvature of an outer surface of the face portion is more than or equal to 10,000 mm in any radial direction passing the center of the face portion; and a length h (mm) of the skirt portion in a tube axis direction from a contact between an end of the effective screen of an inner surface of the face portion and the blend R portion to an edge surface portion where the glass panel is sealed with the funnel at least along a short axis of the glass panel, a deflection angle θ (°) of the yoke portion of the funnel, and a distance H (mm) in the tube axis direction from an edge surface portion where the funnel is sealed with the glass panel to the reference line satisfy the relationship of: $1/(0.22\ \tan(\theta/2))-1 \leqq H/h \leqq 1/(0.16\ \tan(\theta/2))-1$.

* * * * *